United States Patent [19]

Marsh et al.

[11] 4,015,866

[45] Apr. 5, 1977

[54] OPERATING MECHANISM FOR DOUBLE SLIDING DOORS

[75] Inventors: Ronald W. Marsh, Michigan City; Walter J. Marulic, Gary, both of Ind.

[73] Assignee: Pullman Incorporated, Chicago, Ill.

[22] Filed: Oct. 28, 1975

[21] Appl. No.: 626,159

[52] U.S. Cl. ..... 292/36; 292/DIG. 32

[51] Int. Cl.[2] ..... E05C 9/06

[58] Field of Search ..... 292/DIG. 32, DIG. 27, 292/34, 36, 336.3; 70/DIG. 65

[56] References Cited

UNITED STATES PATENTS

| | | | |
|---|---|---|---|
| 2,878,533 | 3/1959 | Beauchamp | 292/36 X |
| 3,138,831 | 6/1964 | Soddy | 292/DIG. 32 |
| 3,776,581 | 12/1973 | Ross, Jr. | 292/DIG. 32 |

*Primary Examiner*—Richard E. Moore
*Attorney, Agent, or Firm*—Richard J. Myers

[57] ABSTRACT

An operating mechanism for a pair of sliding doors includes a rotatable cam actuating member for locking and unlocking one door relative to a door opening of a vehicle. The other is provided with locking bolts which are also actuated by the cam actuating member and include means selectively engageable with said locking bolts whereby both doors may be locked and unlocked simultaneously or only the first door may be so actuated.

10 Claims, 8 Drawing Figures

OPERATING MECHANISM FOR DOUBLE SLIDING DOORS

BACKGROUND OF THE INVENTION

1. Field of the Invention

The invention involves sliding doors or a combination of sliding and sliding plug doors of a type generally utilized on railway box cars.

2. Description of the Prior Art

Prior art patents pertaining to double door arrangements are well known in the art and generally include individual locking mechanisms for each door and interlocking mechanisms for connecting both doors so that they can be moved in unison to one side of a door opening.

The present invention provides for the actuation of both door locking mechanisms from the rotatable cam drive arrangement provided on one of the doors.

SUMMARY OF THE INVENTION

The present invention is applied to a double door arrangement of a type which is used for closing the enlarged door opening of a railway box car. One of the doors is provided with a rotary cam type operating mechanism which during operation opens or closes the locking bolts of the door and operates a crank and pipe mechanism for moving one end of the door laterally on upper and lower tracks relative to the door opening. The second or auxiliary door also includes a locking bolt which is reciprocated by a bell crank. The first door is provided with a linkage and rod mechanism adapted to be reciprocated by the cam type operating mechanism to which it is connected. The linkage is movable to a position to selectively engage or disengage from the bell crank for selectively reciprocating the bolts.

DESCRIPTION OF THE PREFERRED EMBODIMENT

Figure 1:
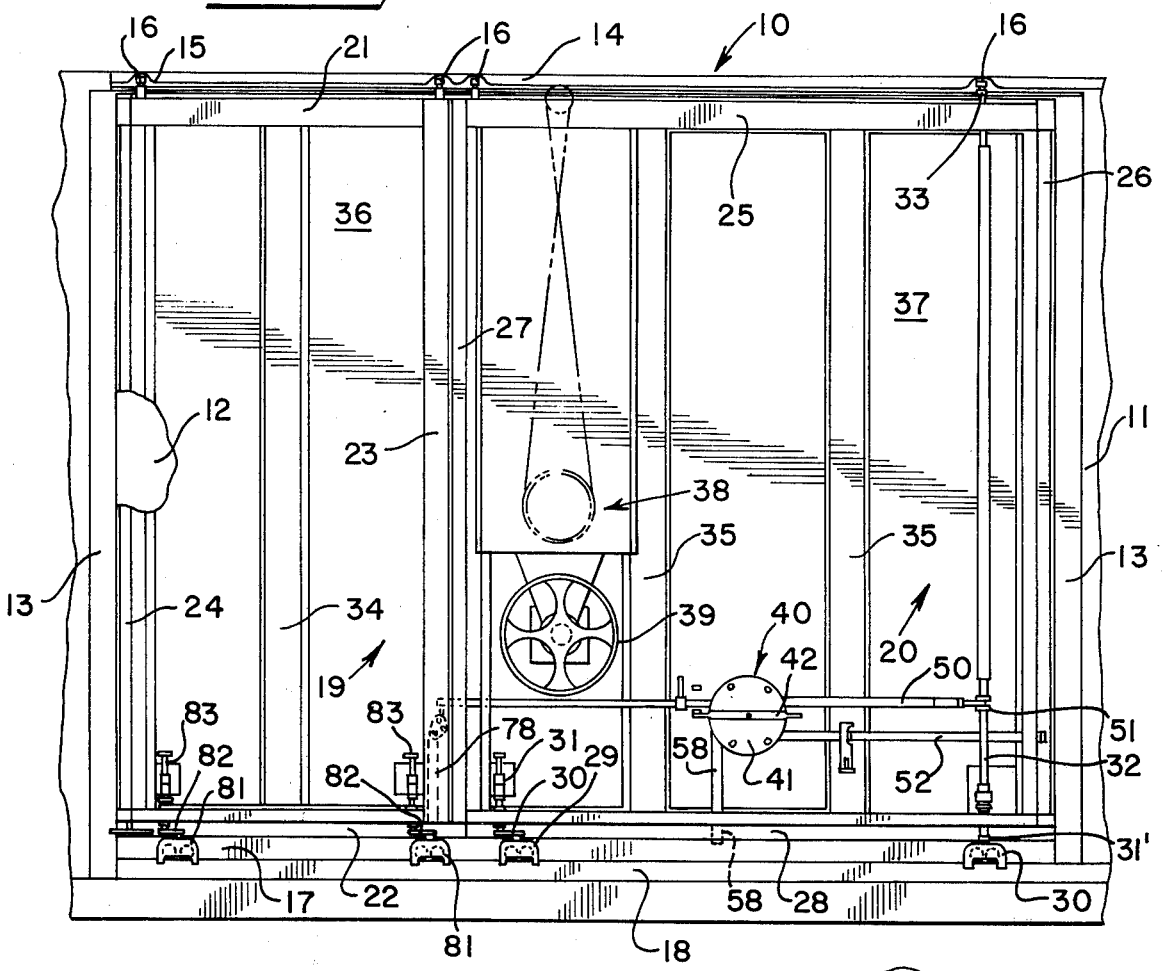
FIG. 1 is a side elevational view of a portion of a railway box car showing a pair of sliding doors with an improved door operating mechanism.

Referring particularly to FIG. 1 a railway box car 10, includes a side wall 11 having an enlarged door opening 12. The door opening 12 comprises side vertical frame members 13, a top header member 14, and a lower vehicle frame member 17 which supports a horizontal guide track 15. The header 14 is shaped to provide a guide means for upper door guides 16 supported on first and second doors 19 and 20. The first door 19 comprises an upper door frame member 21 and a lower door frame member 22. Vertical side door frame members 23 and 24 of channel shaped construction are connected to the door frame members 21 and 22. The second door 20 includes an upper door frame member 25 connected to side door frame members 26 and 27 in turn connected to a lower horizontal door frame member 28. Roller assemblies 29 and 30 are slidably supported on the door track 18. The roller assembly 29 includes a crank arm 30 connected to a swivel part 31. The roller assembly 30 includes a crank arm 31' connected to a pipe 31 rotatably supported on the door 20 and which is provided with a crank arm 33 connected to one of the upper door guides 16. The doors 19 and 20 respectively also include vertical stabilizer beams 34 and 35 connected to door sheathing 36 and 37.

The door 20 is provided with a force multiplying arrangement 38 of a type disclosed in U.S. Pat. No. 3,816,965 issued June 18, 1974. This arrangement permits the operator to slide the door 20 in reciprocating fashion to open and closed positions. An operating wheel 39 connected to actuating mechanism disclosd in the aforementioned patent provides for operation of the arrangement.

A door operating opening and closing mechanism 40 includes a housing 41 having rear and front plates 41' and 42'' supported on the door 20. The mechanism 40 includes a spinner handle 42 connected to a shaft 43 rotatably supported on plates 41' and 42''. The door operating mechanism 40 is more specifically described in U.S. Pat. No. 3,750,335 issued Aug. 7, 1973.

The cam actuator 44 includes a cam dog 45 adapted to rotate a cam 46 rotatable on a pivot member 47. The cam 46 includes a slotted camming surface 48 engaged by the cam dog 46. A pivot 49 on cam 46 is connected to a reciprocating actuating beam 50 which is connected to a bracket 51 for rotating the pipe 32. A cam 54 is pivoted on a shaft 55 and includes a slotted camming surface 56 engaged by the dog 43. A pivot 57 on the cam 54 is connected to reciprocate a vertical locking bolt 58, adapted to engage suitable keeper means 58' in the lower frame member 17.

A door locking mechanism 59 is generally designated on the door 20 and includes a push-pull arm or link 60 pivotally connected as indicated at 61' to the cam 54. The connection is provided by a stub shaft 62 connected to an actuating shaft 63 by means of a sleeve 64 welded to the end of the shaft 63. The sleeve 64 includes an inner bearing surface 65. A second sleeve 67 retains a bearing member 66 within the sleeve 64, said sleeve 66 being connected to the end of the stub shaft 62. A handle 68 is connected to the sleeve 64 for rotating the shaft 63 about its axis. Upper and lower L-shaped stops 69 and 70 are supported on the door 20.

A pair of aligned openings 71 are provided in one of the side frame members 27, through which the shaft 43 projects. The shaft 43 also extends through an opening 72 in one of the webs 73 of the side frame members 23. A hook-shaped latching element engageable means 74 includes a finger 75 adapted to engage a bell crank 76 mounted on a pivot 77. The bell crank 76 includes a keeper opening 78 engageable by the finger 75.

Figure 2:
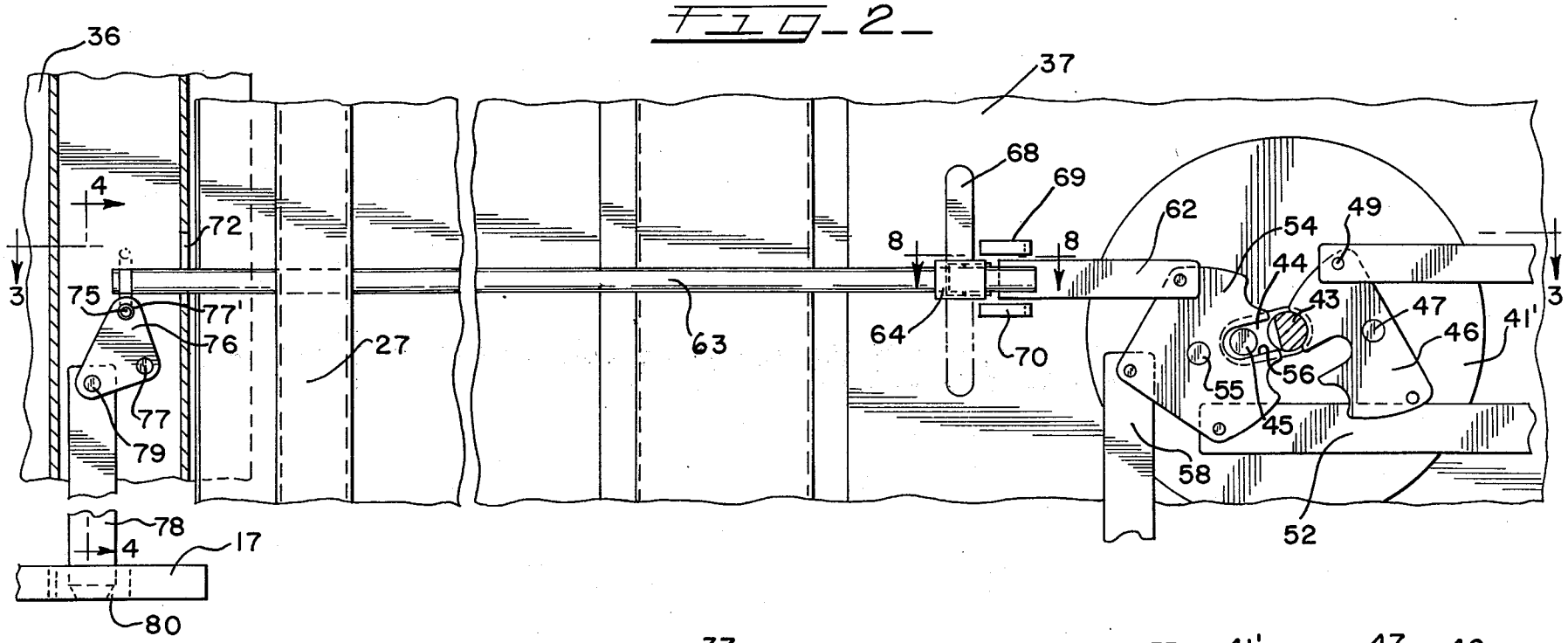
FIG. 2 is side elevational view partially in section of a door operating mechanism.
Figure 3:
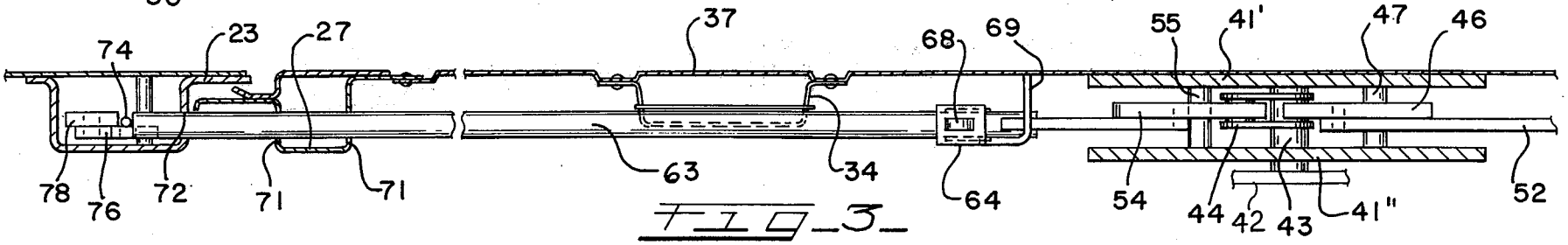
FIG. 3 is a cross-sectional view taken substantially along the line 3—3 of FIG. 2.

The door 19 includes a vertical locking bolt 78 pivotally connected to the bell crank 76. The lower end of the locking bolt, as shown in FIG. 2 is adapted to engage a keeper 80 provided on the frame member 17. The door 19 is slidably supported on the track 17 by means of roller assemblies 81 including conventional crank arms 82 connected to swivel assemblies 83 mounted on the door 19.

OPERATION

Figures 6, 7, 8:
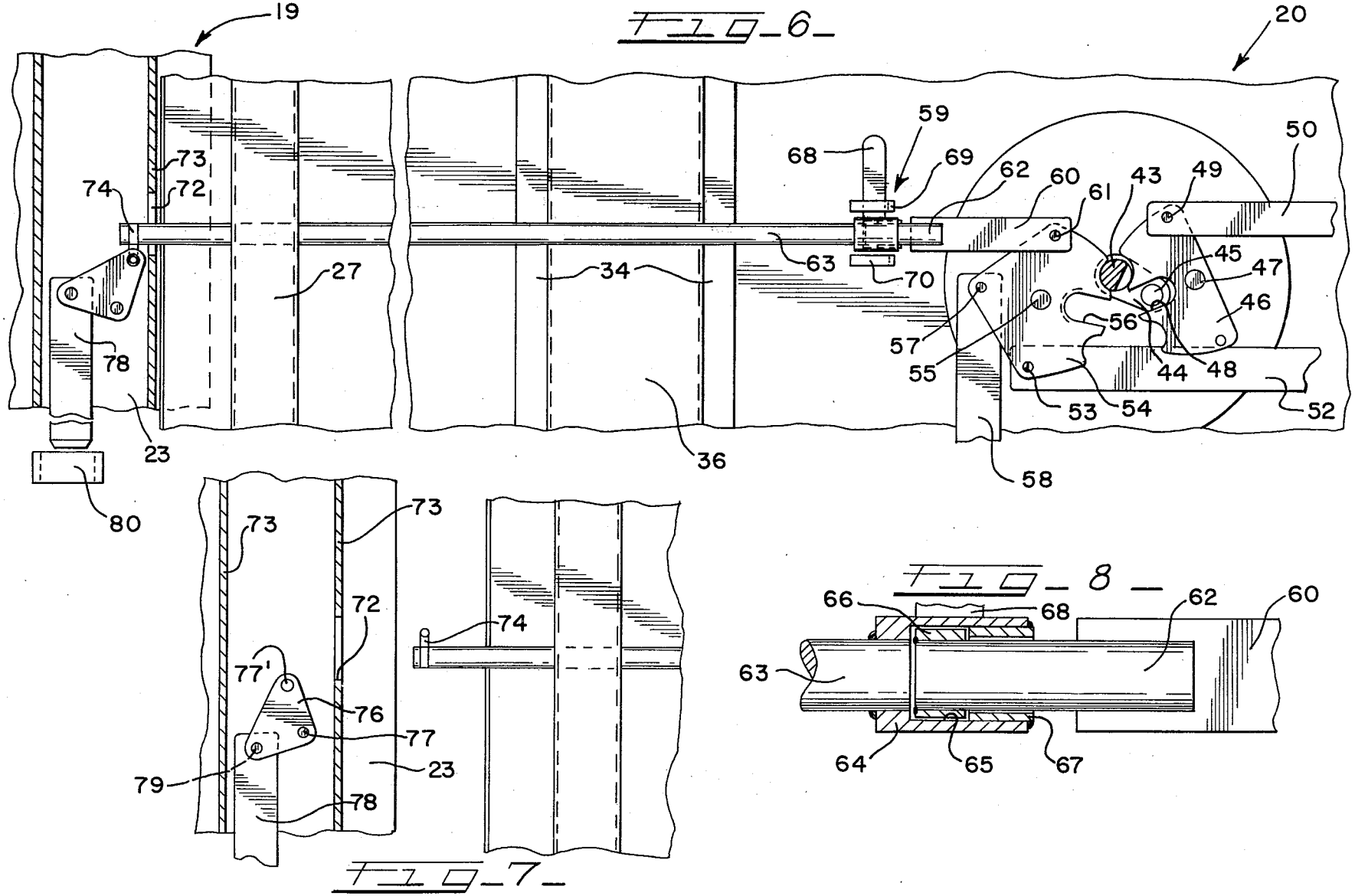
FIG. 6 is a view similar to FIG. 3 showing another position of operation.
FIG. 7 is a detail side elevational view of a portion of a bolt locking mechanism.
FIG. 8 is a cross-sectional view taken along the line 8—8 of FIG. 2.

In the position shown in FIG. 1, doors 19 and 20 are interlocked and the bolts 52, 58 and 78 are suitably engaged with the keepers on the door frame so that the doors are in a locked position. The handle 68 is in the position shown in FIG. 2 in the solid line position. To open both doors from locking engagement the shaft 63 is moved to the right as shown in FIG. 6 by rotation of the cam 54 which is moved by the dog 45 whereupon the bell crank 76 is rotated and the bolt 78 is raised out of locking relation relative to the keeper 80. At the same time the bolt 58 is moved vertically to an open position.

Figure 4:
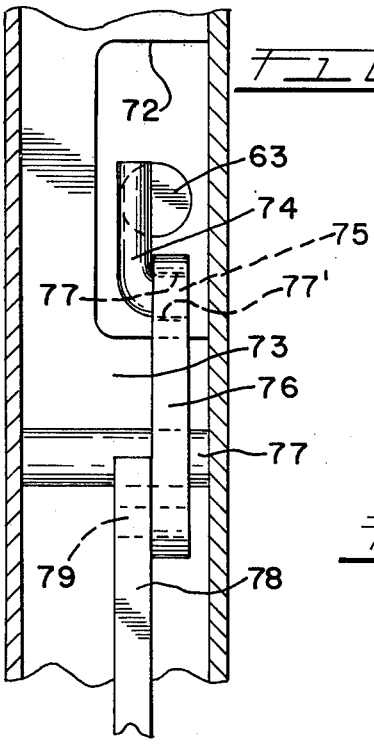
FIG. 4 is a cross-sectional view taken substantially along the line 4—4 of FIG. 2.
Figure 5:
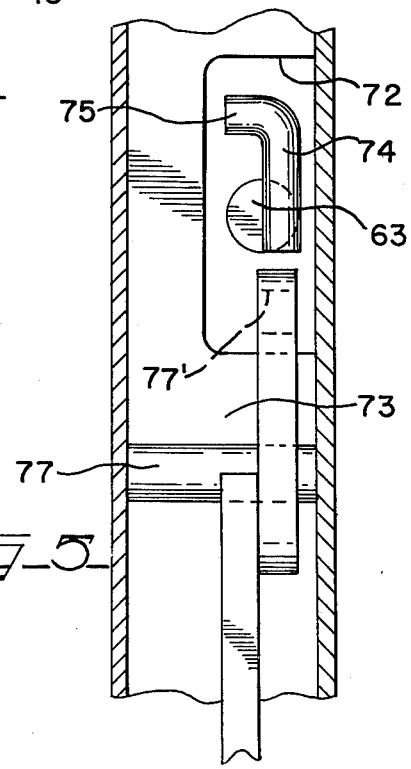
FIG. 5 is a view similar to FIG. 4 showing another position of the operation.

Rotation of the cam 46 is provided by the dog 45 which moves the cam 46 to move rod 50 rotating the pipe 32 which by reason of the crank arm 31' and 33 causes the door to move outwardly or laterally from the door opening. Before sliding the door 20 to the right, the operator now may rotate the handle 68, 180° to the dotted line position shown in FIGS. 2 and 6 wherein the finger 75 is moved outwardly from the keeper 77', as shown in FIG. 5, and the rod 63 and hook 74 may be moved outwardly laterally through the opening 72. At the selection of the operation the bolt 78 may be retained in the locked position, with the door 19 closed and the finger may be moved to the position aforesaid described wherein the door 20 can be moved leaving the door 19 in said locked position. The handle 68 in either the full line, or dotted line positions shown in FIGS. 2 and 6 may be moved to engage the upper and lower stops 69 whereby the finger may be maintained in engaging or disengaging position relative to the keeper opening 77, both of these positions being shown in FIGS. 4 and 5.

If desired, in the position shown in FIG. 6, wherein the bolts of both doors are in unlocked condition, both doors may be moved together to one side of the door opening by means of the force multiplying arrangement 38 and also returned to the closing position.

What is claimed is:

1. A vehicle having a door opening, first and second doors positioned side-by-side in said opening, said doors being slidably supported on said vehicle for sliding movement from a position closing said opening to an open position to one side of said opening, said second door having a bolt locking member engageable with a portion of said vehicle to lock said second door in said opening, and a rotatable member on said second door connected to said locking member for moving the same between locking and unlocking position, the improvement of;

a door locking mechanism for said first door comprising, a second locking bolt connected to said first door for relative sliding movement, a keeper on said vehicle engageable by said second locking bolt, an actuating element movably supported on said (first) door for reciprocating said second locking bolt, actuating linkage mechanism including a rod slidably supported on said second door and being connected to said rotatable member for reciprocating movement in response to rotation of said rotatable member, and means on said rod selectively engageable with said actuating element for moving the same whereby said second bolt is moved into and out of locking position relative to said keeper.

2. The invention in accordance with claim 1, said actuating element comprising a bell crank.

3. The invention in accordance with claim 2 said bell crank having an engageable portion, and said engageable means on said rod including a hook shaped member movable into engagement with said engageable portion.

4. The invention in accordance with claim 1, said locking mechanism including a push-pull member connecting said rod to said rotatable member, and rotatable means connecting said rod to said push-pull member to provide for rotation of said rod thereby moving said engageable means selectively.

5. The invention in accordance with claim 4 said rotatable means including a first sleeve connected to one end of said rod, a bearing member connected to an end of said push-pull member, and means retaining said sleeve on said bearing member.

6. The invention in accordance with claim 5, said bearing member being disposed within said first sleeve, said retaining means including a second sleeve disposed within said first sleeve.

7. The invention in accordance with claim 6, including a handle connected to said rod for rotating the same.

8. The invention in accordance with claim 7, including catch means on said second door maintaining said rod against rotation in a first position when said engageable means is engaged with said actuating element, and in a second position when said engageable means in non-engaging position.

9. The invention in accordance with claim 8, said catch means including a pair of brackets mounted on said second door above and below said rod, slidingly engaged by said handle.

10. The invention in accordance with claim 9, said rotatable member including a cam element.

* * * * *